United States Patent [19]

Festoso et al.

[11] Patent Number: 4,862,553

[45] Date of Patent: Sep. 5, 1989

[54] FURNITURE HANDLES

[76] Inventors: Eugenia Festoso; Antonio Festoso, both of 7520 Bordeaux, Apt. #7, Montreal, Quebec, Canada

[21] Appl. No.: 55,293

[22] Filed: May 29, 1987

[51] Int. Cl.[4] ..... G09F 3/00; G09F 3/18

[52] U.S. Cl. ..... 16/124; 40/325; 40/649; 40/650

[58] Field of Search ..... 16/124, 114 R, 110 R; 40/16, 325, 649, 650

[56] References Cited

U.S. PATENT DOCUMENTS

| | | | |
|---|---|---|---|
| 467,487 | 1/1892 | Whittier | 40/325 |
| 1,822,213 | 9/1931 | Hamilton | 40/325 |
| 1,864,656 | 6/1932 | LeBeaumont | 40/16 X |
| 2,065,296 | 12/1936 | Wege . | |
| 2,835,917 | 5/1958 | Smythe et al. | 16/124 |
| 3,102,763 | 9/1963 | Knoll et al. . | |
| 3,238,656 | 3/1966 | Berger . | |

FOREIGN PATENT DOCUMENTS

| | | | |
|---|---|---|---|
| 335719 | 9/1933 | Canada . | |
| 344742 | 9/1934 | Canada . | |
| 409836 | 1/1943 | Canada . | |
| 734263 | 5/1966 | Canada . | |
| 1060936 | 8/1979 | Canada . | |
| 3219926 | 1/1983 | Fed. Rep. of Germany | 16/110 R |

*Primary Examiner*—Nicholas P. Godici
*Assistant Examiner*—Carmine Cuda
*Attorney, Agent, or Firm*—W. Charles Kent; William R. Edgar

[57] ABSTRACT

A handle for a drawer or the like comprising an elongated body with a slot in its front to removably receive a colored decorator strip, the slot extending over most of the length of the body. A curved surface is provided behind the front to permit gripping the handle by one's fingers.

6 Claims, 1 Drawing Sheet

FURNITURE HANDLES

The present invention relates to furniture handles and the like, and more particularly to a functional, decorative handle which may be used on furniture and which will provide a variety of different accent colours for such furniture.

BACKGROUND OF THE INVENTION

Decorative strips have been held in grooves mounted on the front of sheet metal shelving to provide an attractive and sales-appealing construction of shelving, in Wege U.S. Pat. No. 2,065,296 issued Dec. 22, 1936. Slotted mouldings have been used for holding and displaying price tags on store shelving displays (see, for example, Marsh Canadian Patent No. 344,742 issued Sept. 18, 1934 and Esdorn Canadian Patent No. 335,719 issued Sept. 19, 1933).

Madey Canadian Patent No. 734,263 issued May 17, 1966 describes and illustrates another type of label holding structure for store displays.

Ring Canadian Patent No. 409,836 issued Jan 5, 1943 describes and illustrates a construction of handle, for example for a drawer or door in an electric stove or other such appliance, which handle is provided with a groove in which a decorative band is held. The band is held in position by securing means provided at the ends. Klaus Canadian Patent No. 1,060,936 issued Aug. 21, 1979, Knoll, et al U.S. Pat. No. 3,102,763 issued Sept. 3, 1963 and Kanzelberger U.S. Pat. No. 3,238,656 issued Mar. 8, 1966 describe and illustrate different constructions of drawer handles or pulls having, in combination therewith, label holder sections. In such prior art constructions, the gripping surface for the drawer handle or pull is remote from and unassociated with the label holding section of the handle or pull.

It is an object of the present invention to provide a novel construction of furniture handle which combines the functional finger-gripping shape of the handle with an ornamental or decorative colour strip holder.

SUMMARY OF THE INVENTION

In accordance with the present invention a furniture handle for a drawer, cupboard door or the like is provided, which handle comprises an elongated body having a front, back, bottom, top and two sides. The bottom is curved upwardly and rearwardly to provide a surface for gripping by one's fingers. The front is planar and has a longitudinally extending slot which extends over most of its length to slidably receive and maintain in position, visible from the front, a coloured decorator strip.

In a preferred embodiment, the handle is provided with stops at either end of the slot, to prevent removal of a strip held in position within the slot. One of the stops is removably securable within one end of the slot to permit removal or insertion of a decorator strip within the slot when the stop is removed.

The furniture handle in accordance with the present invention is both easy to construct and attractive in appearance. The grooved construction of the front of the handle permits use of coloured decorator strips to be selected as desired and changed at will, for example to complement the colour scheme of the room in which furniture bearing such handles is situated.

BRIEF DESCRIPTION OF THE DRAWINGS

These and other objects and advantages of the invention will become apparent upon reading the following detailed description and upon referring to the drawings in which.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

Figure 1:
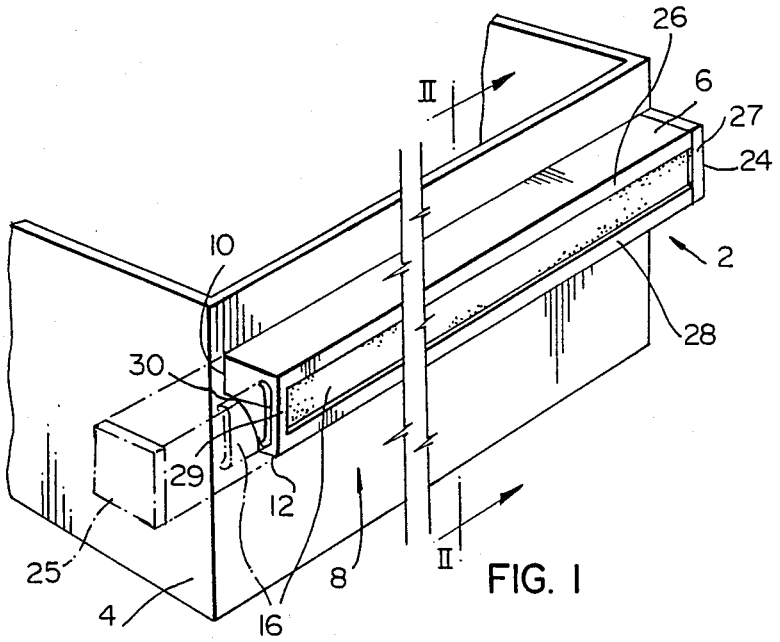
FIG. 1 is a perspective view, partially exploded, of a handle in accordance with the present invention mounted on a drawer.

Turning to FIG. 1, there is shown a handle 2 secured to the front of a drawer 4 by appropriate securing means (e.g. glue, screws). Handle 2 comprises an elongated body 6 having a front 8 made up of a wide, planar face as illustrated, and a back 10 which bears against the front of drawer 4 when the handle is secured in position. Body 6 is also provided with a bottom 12 having at one side a concave surface 13 curved upwardly and rearwardly behind the face as illustrated, to provide a gripping surface for one's fingers when it is desired to open the drawer.

On the front 8 of body 6 extending over most of its length, a slot 14 is provided, within which a coloured decorator strip 16 is to be held.

Figure 2:
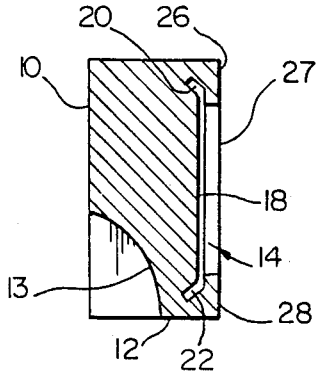
FIG. 2 is a section view along line II—II of FIG. 1.

As can be seen in FIG. 2, slot 14 has a flat base 18, its plane being parallel to that of the face generally and spaced grooves 20 and 22 on either side of base 18. Grooves 20 and 22 are angled outwardly and downwardly with respect to base 18 and slidably receive the sides of strip 16 to hold the strip in position in handle 2. As can be seen particularly in FIGURE 2, the handle of the present invention can be readily formed from a piece of material (e.g. wood) of rectangular cross-section with very few machining operations (one concave curved cut to remove one corner, one cut to form slot 14, and two cuts to form grooves 20 and 22).

Stops 24 and 25 are provided at each end of slot 14, extending between grooves 20 and 22, to prevent sideways removal of strip 16 when in position in slot 14. Stop 25 is removable as illustrated to provide access to slot 14 for inserting in or removal from slot 14 of a strip 16. With this construction, a strip 16 when in position is neatly framed by face edge portions 26, 27, 28 and 29. An appropriate aperture 30 is formed in portion 29 to provide access of strip 16 to slot 14. Stop 25, when in position, blocks aperture 30.

Thus, with this relatively simple construction, an extremely effective combination of function and decoration has been achieved. The shaping of handle 2, and in particular wide front 8 in combination with curved bottom 12, permits a wide, front surface for displaying of a decorator strip 16 in co-operation with a finger gripping surface for grasping the handle to open the drawer. It will be readily appreciated that, by removing the removable stop 25, a decorator strip 16 may be replaced with one of a different colour or the like, permitting coordination of the colouring of the furniture on which handle 2 are mounted, with the colour scheme of the room in which such furniture is found.

Thus it is apparent that there has been provided in accordance with the invention, furniture handles or the like that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A furniture handle for a drawer, cupboard door or the like comprising an elongated body having a front, back, bottom and top and two sides, the bottom curved upwardly and rearwardly to provide a surface for gripping by one's fingers, the front being planar and having a longitudinally extending slot extending over most of its length to slidably receive and maintain in position visible from the front a coloured decorator strip, the slot comprising a flat base having a plane parallel to that of the front, and spaced grooves on either side thereof angled outwardly and downwardly with respect to the base to slidably receive the sides of the strip and hold it in position, and the slot circumscribed by edge portions to frame the strip, when in position.

2. A handle according to claim 1 wherein the slot commences at one side of the body via a side aperture and extends to a stop positioned near the other side of the body, the stop positioned to prevent removal of the decorator strip when in position from that side of the body.

3. A handle according to claim 1 in combination with a coloured decorator strip in position in the slot.

4. A handle according to claim 1 further provided with stops at each end of the slot to prevent removal of a strip held in position within the slot, one of the stops being removably securable over one end of the slot to permit removal or insertion of a decorator strip within the slot.

5. A handle according to claim 1 wherein the back is provided with a surface to mateably receive a front surface of the furniture, when the handle is secured to the furniture.

6. A handle according to claim 1, formed from a piece of material of rectangular cross-section, a rear corner of which has been removed by a concave curved cut.

* * * * *